US006173634B1

(12) United States Patent
Lynch et al.

(10) Patent No.: US 6,173,634 B1
(45) Date of Patent: Jan. 16, 2001

(54) METHOD AND APPARATUS FOR COLLECTING AND REMOVING PUNCH CHAFF FROM AN IMAGING SYSTEM

(75) Inventors: Richard J. Lynch, Peabody, MA (US); James D. Waterman, Newton, NH (US)

(73) Assignee: Agfa Corporation, Wilmington, MA (US)

( * ) Notice: Under 35 U.S.C. 154(b), the term of this patent shall be extended for 0 days.

(21) Appl. No.: 09/273,069

(22) Filed: Mar. 19, 1999

(51) Int. Cl.[7] ..... B26F 1/08

(52) U.S. Cl. ..... 83/54; 83/23; 83/78; 83/109; 83/167; 83/560; 83/948

(58) Field of Search ..... 83/23, 560, 78, 83/167, 109, 948, 54

(56) References Cited

U.S. PATENT DOCUMENTS 4,509,397 * 4/1985 Mori et al. ..... 83/453
5,638,730 * 6/1997 Karlis ..... 83/167
5,655,452 * 8/1997 Blake et al. ..... 101/477
5,709,139 * 1/1998 Shimizu et al. ..... 83/948
5,842,397 * 12/1998 Shimizu et al. ..... 83/948
5,953,807 * 9/1999 Garland ..... 83/54
5,996,206 * 12/1999 Lynch et al. ..... 83/54

* cited by examiner

*Primary Examiner*—M. Rachuba
*Assistant Examiner*—Sean Pryor
(74) *Attorney, Agent, or Firm*—John A. Merecki; Robert A. Sabourin

(57) ABSTRACT

A method and apparatus for collecting and removing chaff from an internal drum imaging system. The chaff collection apparatus includes a chaff tray coupled to the internal drum below the side punches. The chaff tray includes a cover comprising a plurality of evenly spaced frangible fingers. A specific set of the fingers is removed from the cover according to the locations of the side punches on the internal drum. In this manner, only the portions of the cover below the side punches are open to the interior of the chaff tray. The chaff produced by each punch passes into the chaff tray through a respective opening in the cover, and is captured within the chaff tray. The areas of the cover of the chaff tray that are not located below the side punches remain covered by the remaining frangible fingers, thereby preventing chaff from escaping the chaff tray.

9 Claims, 5 Drawing Sheets

METHOD AND APPARATUS FOR COLLECTING AND REMOVING PUNCH CHAFF FROM AN IMAGING SYSTEM

FIELD OF THE INVENTION

The present invention is in the field of imaging systems. More particularly, the present invention provides a method and apparatus for the collection and removal of pieces of recording media, hereinafter referred to as "chaff," punched out by the side punches of an imaging system.

BACKGROUND OF THE INVENTION

In many imaging systems, such as imagesetters or platesetters, a movable optical carriage is used to displace a laser system or other imaging source in a slow scan direction along an internal drum to expose a supply of recording media supported on the drum. Generally, the imaging source includes a beam deflection assembly, comprising a deflector element (e.g., a mirror) and a spin motor for rotating the deflector element to deflect an imaging beam generated by a radiation source across the recording media. Such an imaging system is described, for example, in U.S. Pat. No. 5,598,739, assigned to Agfa Corporation, incorporated herein by reference.

As known in the art, imaging systems are commonly equipped with internal punches that are configured to punch a predetermined set of registration openings (e.g., holes, notches, etc.), into the recording media being imaged. Advantageously, by registering the recorded image to the set of holes in the recording media, accurate registration throughout the prepress process can be achieved. A virtually limitless number of positions, types, and configurations of punches are possible in imaging systems due, for example, to the availability of a large number of different types of punches, registration systems, and printing presses, as well as the use of a wide variety of sizes of recording media, etc.

If steps are not taken to immediately collect the chaff produced by the punches, the chaff may accumulate within, or be blown around, the interior of the imaging system. The chaff, if uncollected, may be deposited onto the recording media prior to, or during, imaging, thereby adversely affecting imaging quality and accuracy. The chaff may also foul various subsystems within the imaging system, or may cause other problems in the imaging system. Accordingly, chaff collection systems have been developed and used to collect and remove the chaff generated by the punches of imaging systems. Unfortunately, currently available chaff collection systems that are designed to accommodate a multitude of different punch positions and punch types are incapable of effectively collecting and capturing the chaff produced by the punches. For example, chaff collection systems have employed large open trays to accommodate all potential punch positions. While the chaff is usually initially captured within such trays, the chaff is often blown out of the open trays into the imaging system by streams of air produced by the vacuum systems, fans, etc., of the imaging system, thereby defeating the intended purpose of the chaff collection system.

SUMMARY OF THE INVENTION

The present invention provides a method and apparatus for the effective collection and removal of chaff from an internal drum imaging system. The present invention further provides a chaff collection apparatus capable of accommodating a large number of punch positions and types of punches, and permanently capturing the chaff produced by the punches of an imaging system.

The chaff collection apparatus according to the present invention comprises an arcuately shaped chaff tray that conforms to the curvature of the cylindrical imaging surface of the internal drum. The chaff tray is coupled in any suitable manner to the side of the internal drum below the side punches.

The chaff tray includes a cover comprising a plurality of evenly spaced frangible sections, hereinafter referred to as "fingers." Prior to, or after, coupling the chaff tray to the side of the internal drum, a specific set of the fingers is removed from the cover according to the locations of the side punches on the internal drum. In this manner, only the portions of the cover below the side punches are open to the interior of the chaff tray. The chaff produced by each punch passes into the chaff tray through a respective opening in the cover, and is captured within the chaff tray. Advantageously, areas of the cover of the chaff tray that are not located below the side punches are covered by the remaining frangible fingers, thereby preventing chaff from escaping the chaff tray.

Generally, the chaff collection apparatus of the present invention comprises:

a system for collecting chaff produced by at least one punch, the chaff collection system including a chaff tray and a cover formed by a plurality of removable fingers.

The present invention additionally provides a method for collecting chaff produced by at least one punch, comprising:

providing a chaff tray having a cover formed by a plurality of removable fingers; and selectively removing a specific set of the removable fingers from the cover according to a location of each punch, thereby forming a respective opening in the cover for the collection of chaff produced by each punch.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
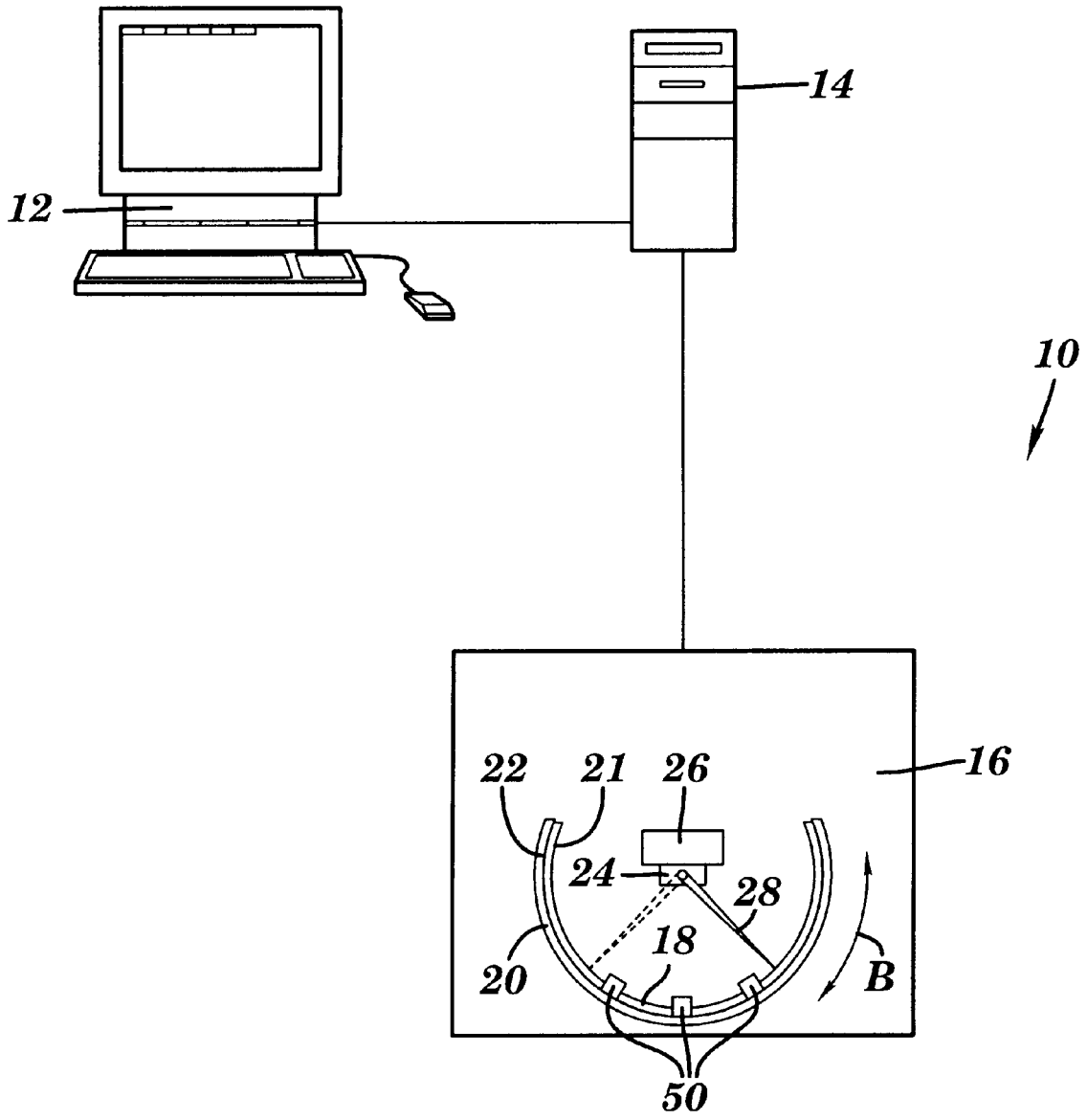
FIG. 1 illustrates an example of an imaging system.

The features and advantages of the present invention are illustrated in detail in the accompanying drawings, wherein like reference numerals refer to like elements throughout the drawings. Although the drawings are intended to illustrate the present invention, the drawings are not necessarily drawn to scale.

An example of an internal drum imaging system 10 is illustrated in FIG. 1. In this example, the imaging system 10 comprises an imagesetter configured to image digital data onto a supply of film, a printing plate, or other recording media. Although described below with regard to an imagesetter, the present invention may be used in conjunction with a wide variety of other types of internal drum imaging systems, including platesetters and the like, without departing from the intended scope of the present invention as set forth in the claims.

The imaging system 10 generally includes a front end computer or workstation 12 for the design and layout of pages to be printed, a raster image processor (RIP) 14 for rasterizing the page data, and an imagesetter 16. The imagesetter 16 records the digital data provided by the RIP 14 onto a supply of photosensitive, radiation sensitive, thermally sensitive, or other type of suitable recording media 18.

The imagesetter 16 includes an internal drum 20 having a cylindrical support surface 22 for supporting and positioning the recording media 18 during imaging. The imagesetter 16 further includes a scanning system 24, carried by a movable optical carriage 26, for recording digital data onto the recording media 18 using an imaging beam 28.

Figure 2:
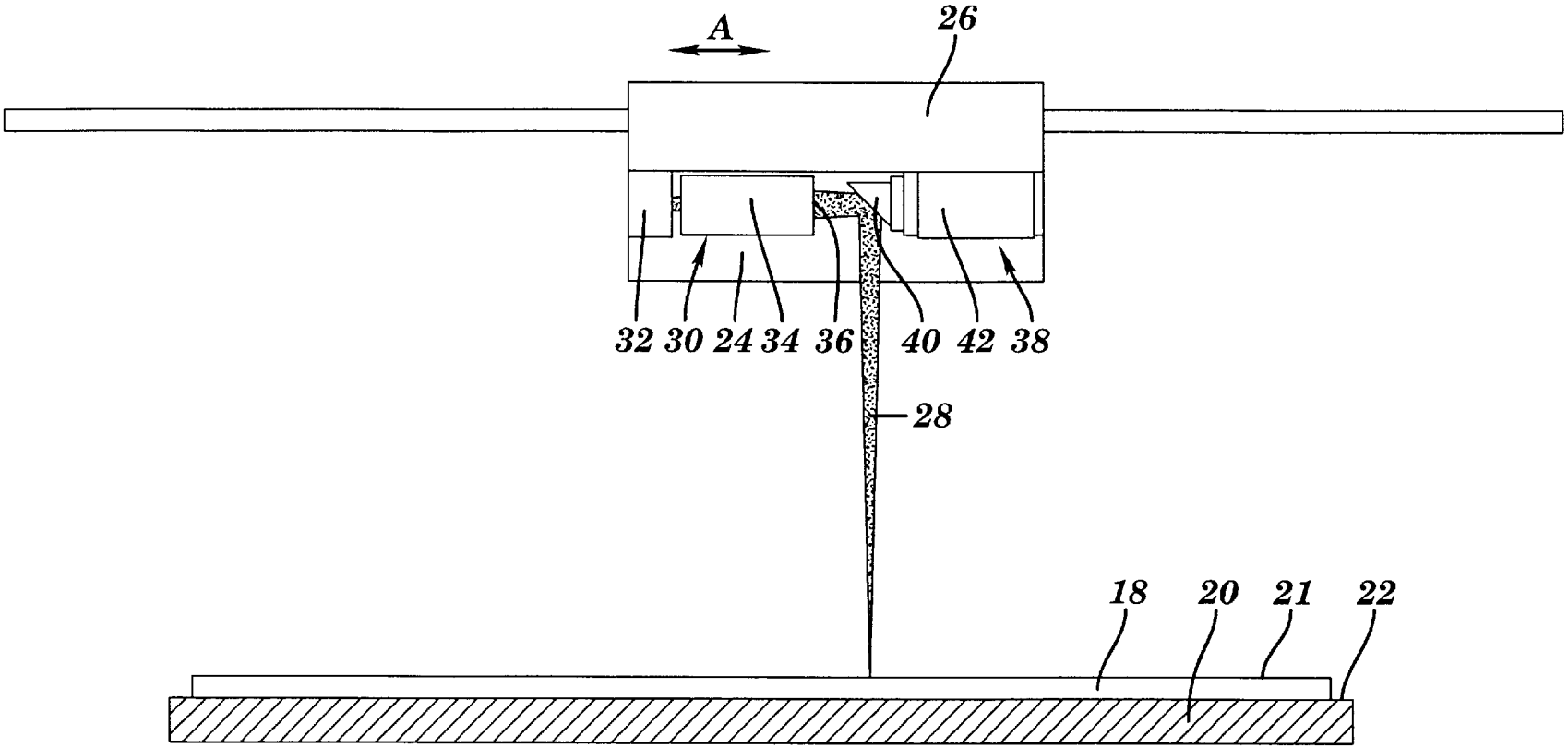
FIG. 2 illustrates the movable optical carriage and scanning system of the imaging system of FIG. 1.

As illustrated in FIG. 2, the scanning system 24 is displaced by the movable optical carriage 26 in a slow scan direction (directional arrow A) along the internal drum 20 to expose the recording media 18 in a line-wise manner. The optical carriage 26 is preferably displaced by an onboard drive system (not shown), although an external drive system may also be used.

The scanning system 24 typically includes a laser system 30 for generating the imaging beam 28. The laser system 30 comprises a light or radiation source 32 for producing the imaging beam 28, and an optical system 34 positioned between the radiation source 32 and the imaging surface 21 of the recording media 18 for focusing the imaging beam 28 onto the recording media 18. The imaging beam 28 exits the optical system 34 through a spot focusing lens 36. The scanning system 24 further includes a beam deflection assembly 38 for deflecting the imaging beam 28 across the recording media 18 in a fast scan curvilinear direction B (see FIG. 1) to record a scan line on the imaging surface 21 of the recording media 18. The beam deflection assembly 38 comprises a deflector element 40 (e.g., a mirror) and a spin motor 42 for rotating the deflector element 40. As the deflector element 40 is rotated by the spin motor 42, the imaging beam 28 is scanned across the recording media 18 as shown in FIG. 1, thereby imaging a scan line on the recording media 18.

Referring again to FIG. 1, at least one side punch 50 is positioned and attached in a known manner to an end 52 (FIG. 3) of the internal drum 20. The punches 50 are provided to punch a predetermined set of registration holes, notches, etc., in the recording media 18. By aligning the recorded image to the set of holes in the recording media 18, accurate registration throughout the prepress process can be achieved.

Figure 3:
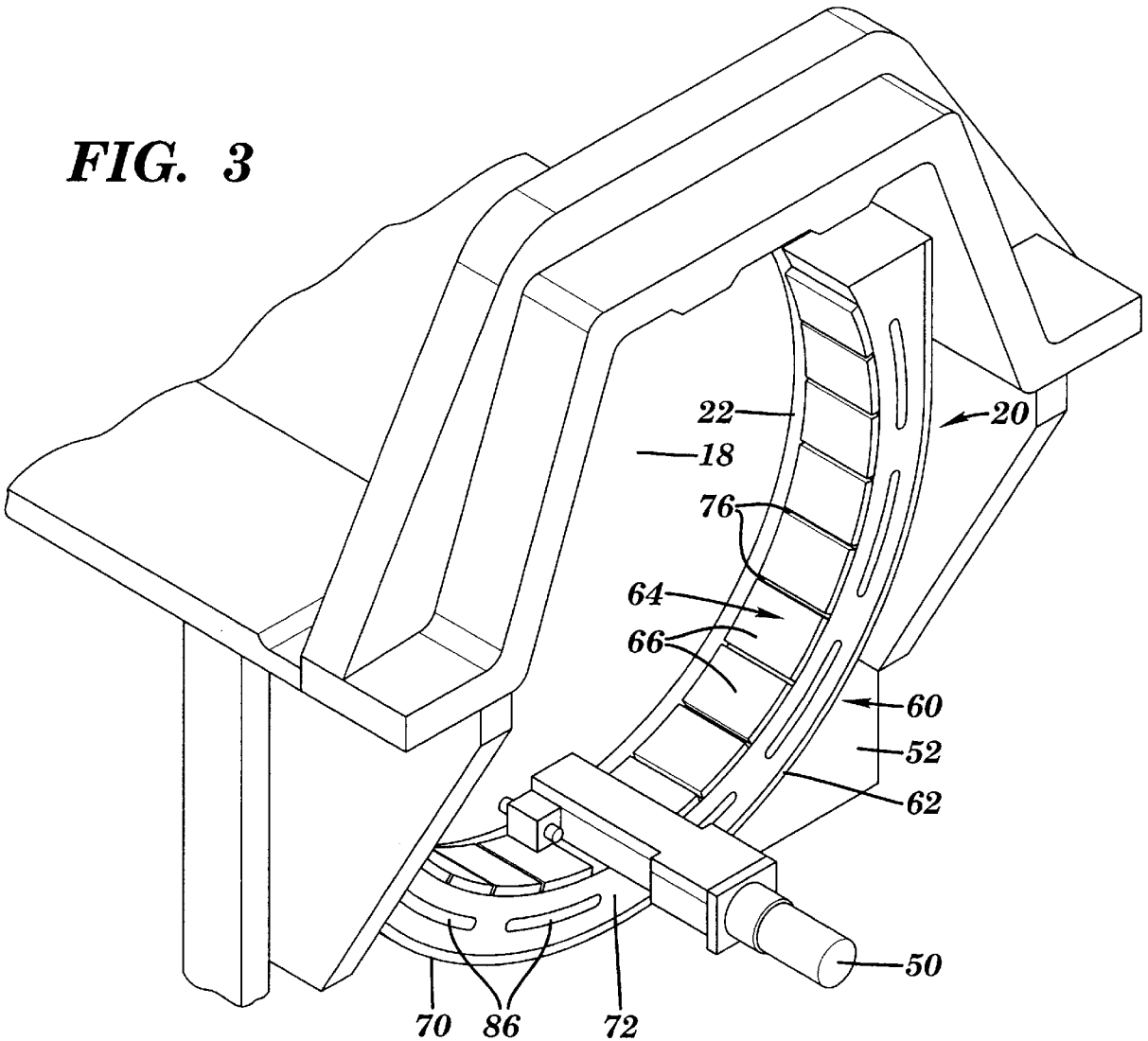
FIG. 3 is a perspective view of a chaff collection apparatus according to a preferred embodiment of the present invention, wherein the chaff collection apparatus is coupled to an internal drum imaging system to capture and remove chaff produced by at least one side punch.

A perspective view of a chaff collection apparatus 60 according to a preferred embodiment of the present invention is illustrated in FIG. 3. The chaff collection apparatus 60 is coupled to the internal drum 20 of an imaging system to capture and remove chaff punched out of the recording media 18 by at least one side punch 50.

Figure 4:
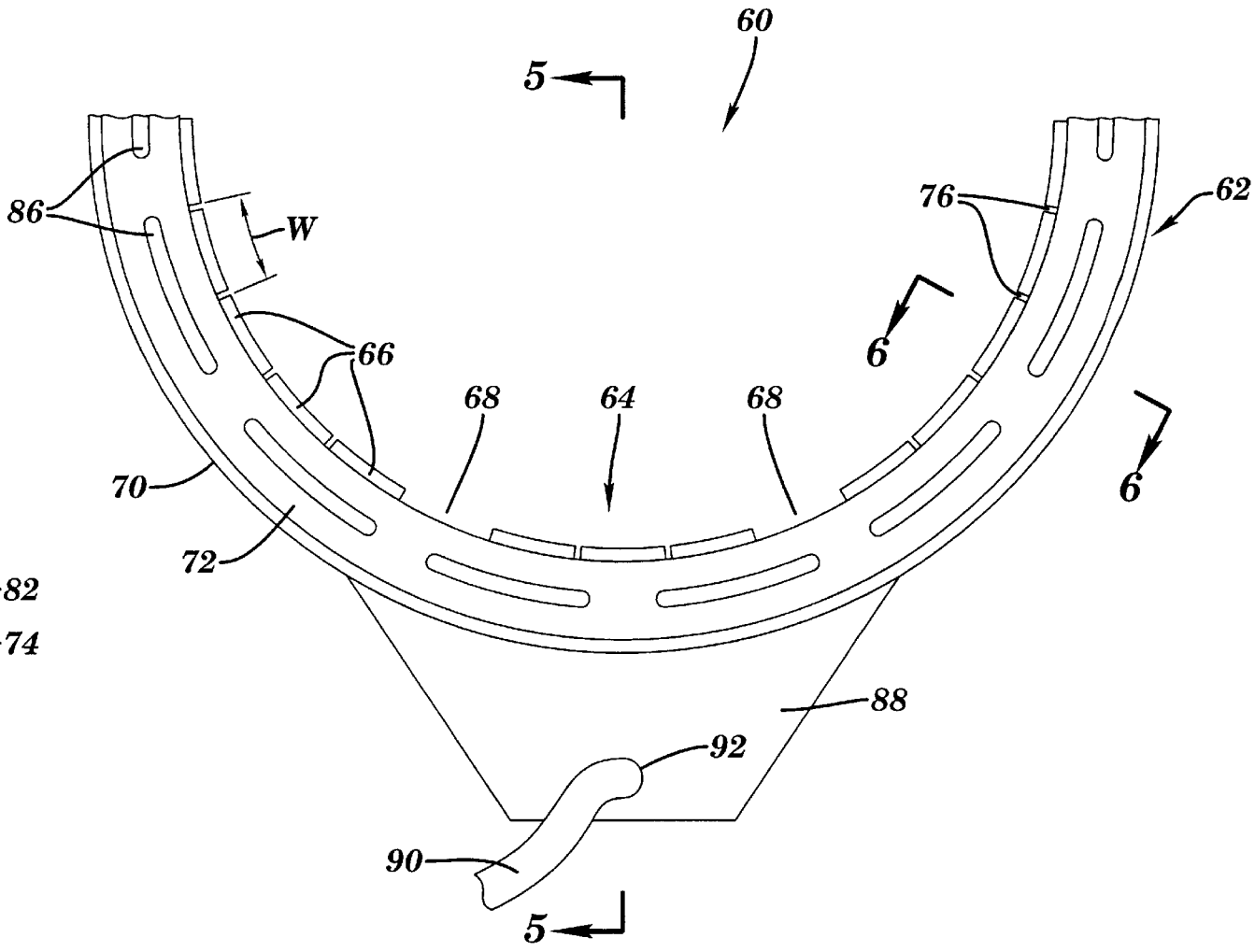
FIG. 4 is a side view of a chaff collection apparatus in accordance with the preferred embodiment of the present invention.
Figure 5:
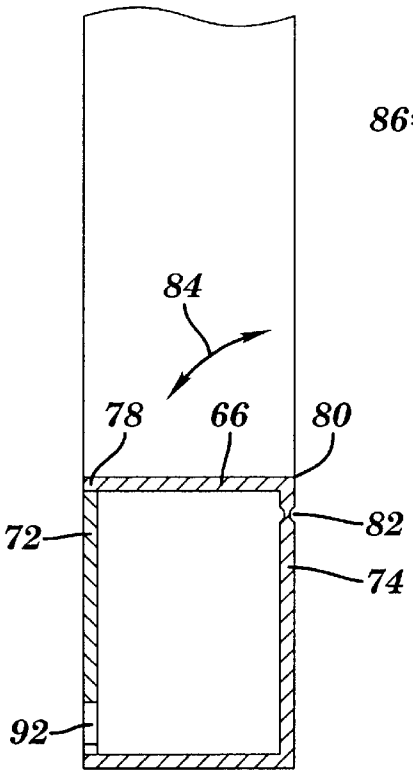
FIG. 5 is a cross-sectional view taken along line 5—5 of FIG. 4.
Figure 6:
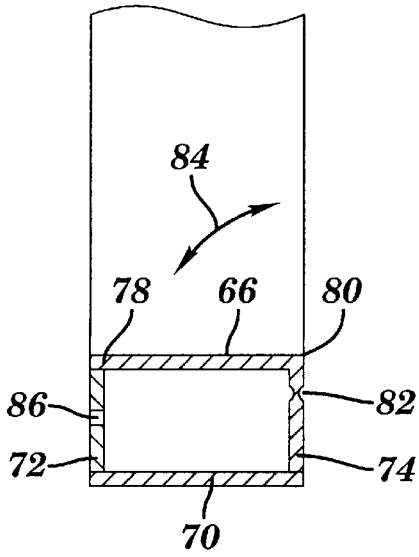
FIG. 6 a cross-sectional view taken along line 6—6 of FIG. 4.

The chaff collection apparatus 60 includes a chaff tray 62 having a cover 64 comprising a plurality of evenly spaced frangible fingers 66 for effectively sealing the chaff tray 62. Depending on the specific location and type of the side punches 50 to be, or previously, mounted on the internal drum 20, a specific set of the fingers 66 is removed from the cover 64 to produce openings 68 (FIG. 4) in the cover 64. In practice, the set of fingers 66 is typically removed prior to the installation of the punches 50. During the operation of the punches 50, the chaff produced by each punch 50 falls into the chaff tray 62 through a respective opening 68 located below the punch 50.

As shown in FIGS. 3–6, the chaff collection apparatus 60 generally has an arcuate configuration corresponding to the curvature of the cylindrical imaging surface 22 of the internal drum 20. The chaff collection apparatus 60 is mounted to the end 52 of the internal drum 20 to position the chaff tray 62 below the side punches 50. The chaff collection apparatus 60 may be mounted to the internal drum 20 using brackets or any other suitable mounting or attaching hardware (not shown).

Continuing to refer to FIGS. 3–6, the chaff tray 62 includes a bottom section 70, a front section 72, and a rear section 74. Together, the bottom, front, and rear sections 70, 72, and 74 form an arcuately shaped chaff tray 62, for the collection of chaff produced by the side punches 50. The chaff tray 62 is covered by the plurality of frangible fingers 66 that form the cover 64. The bottom, front, and rear sections 70, 72, and 74 of the chaff tray 62, and the plurality of frangible fingers 66, may be formed as a single unit. Preferably, however, the front section 72 is formed as a separate piece that is removably insertable between the bottom section 70 and the plurality of fingers 66. This allows the front section 72 to be removed as necessary to clear chaff jams in the chaff tray 62, or to remove the chaff that has collected within the chaff tray 62.

In operation, one or more of the frangible fingers 66 are removed from the cover 64 in accordance with the location and type of each of the side punches 50. In this manner, openings 68 are produced below each side punch 50 that allow the chaff generated by each side punch 50 to fall into the chaff tray 62 for collection. The areas of the cover 64 of the chaff tray 62 that are not located below the side punches 50 (e.g., between, and to the sides of, the openings 68) remain covered by the frangible fingers 66 that have not been removed, thereby preventing the chaff from leaving the chaff tray 62. The width W (FIG. 4) of each finger 66, as well as the size/type of each side punch 50, determine the number of fingers 66 that must be removed from the cover 64 below each side punch 50 to effectively capture the chaff in the chaff tray 62. The width of the openings 76 between each of the fingers 66 is minimized to prevent the chaff from escaping from the chaff tray 62 through the openings 76.

Each of the frangible fingers 66 comprises a first portion 78 that extends to, and/or is supported by, the front section 72 of the chaff tray 62, and a second portion 80 that includes an area 82 of reduced material thickness. The area 82 of reduced material thickness acts as a snap or separation line for the selective removal of a finger 66. To remove a finger 66 from the cover 64, a user repeatedly bends the finger 66 about the area 82 of reduced material thickness, as indicated by directional arrow 84 (FIGS. 5 and 6), until separation occurs due to material failure. Preferably, the fingers 66 are formed from plastic, metal, or other suitable material that will fail in response to repeated bending. The chaff tray 62, and other components of the chaff collection apparatus 60, may be formed of a wide variety of materials including plastic, metal, and the like. In alternate embodiments of the present invention, a score line, perforations, or other separable structure may be used in lieu of the area 82 of reduced material thickness to allow for the removal of the fingers 66 from the cover 64 of the chaff tray 62.

The front section 72 of the chaff tray 62 may include a plurality of slots 86. The slots 86 extend through the front section 72 of the chaff tray 62 allowing access to the interior of the chaff tray 62. The slots 86 allow a user to clear chaff jams in the chaff tray 62 by inserting and manipulating a small diameter or suitably sized tool into the interior of the chaff tray 62. The slots 86 are preferably sized to prevent the chaff from escaping from the chaff tray 62 through the slots 86. The slots 86 are not necessary if the front section 72 is formed as a separate piece that is removably insertable between the bottom section 70 and the plurality of fingers 66. In that case, the front section 72 may be removed to clear chaff jams or to remove the chaff that has been captured within the chaff tray 62.

The chaff deposited within the chaff tray 62 is preferably collected within a funnel shaped collection area 88 that is located below the center point of the chaff tray 62. Specifically, the chaff generated by the punches 50 travels downward through the sides of the chaff tray 62 into the collection area 88. A vacuum source 90 (FIG. 4) can be periodically or continuously applied to an opening 92 in the collection area 88 to draw the chaff into, and/or to remove the chaff from, the collection area 88.

The chaff collection apparatus 60 of the present invention can be configured for use with a wide variety of punch positions and types of punches by selectively removing a set of the frangible fingers 66 from the cover 64 of the chaff tray 62. The act of removing some of the frangible fingers 66, however, may render the chaff collection apparatus 60 unsuitable for use with other, substantially different, punch configurations. Nevertheless, the cost of replacing one chaff collection apparatus 60 for another is relatively inexpensive, especially if the components of the chaff collection apparatus 60 are molded from plastic, or are constructed from other low cost materials.

Figure 7:
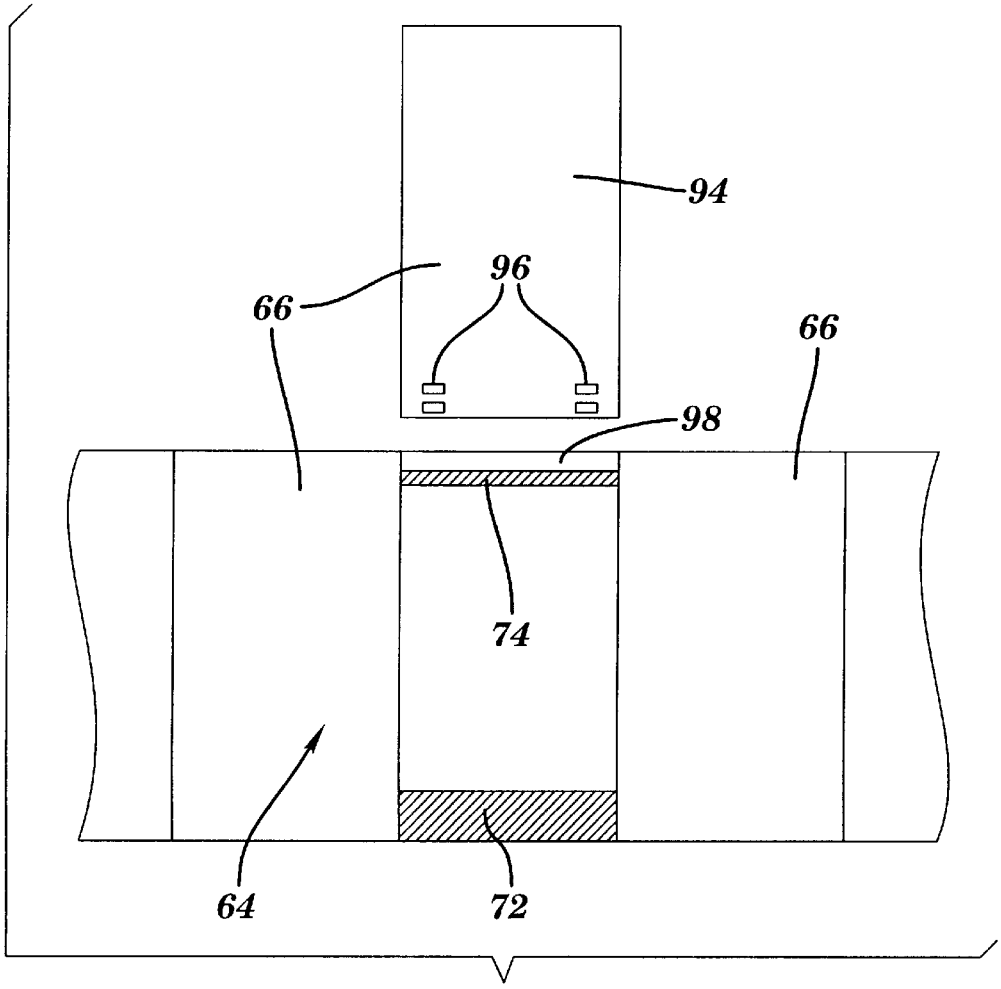
FIG. 7 is a top view of an alternate embodiment of the fingers forming the cover of the chaff collection apparatus.

The reuse of the chaff collection system 60 for different punch configurations may be achieved, for example, by substituting hinged, replaceable (e.g., snap-on, magnetically attached), slidable, or other reusable fingers in lieu of the frangible fingers 66 detailed above. For instance, as illustrated in FIG. 7, the cover 64 of the chaff tray 62 may be formed using a plurality of snap-on fingers 94. Each snap-on finger 94 may include a connecting mechanism 96 that is configured to releasably engage a complementary connecting mechanism 98 located on the rear section 74 (or front section 72, or both) of the chaff tray 62.

The foregoing description of the present invention has been presented for purposes of illustration and description. It is not intended to be exhaustive or to limit the invention to the precise form disclosed, and many modifications and variations are possible in light of the above teaching. For example, the chaff collection apparatus of the present invention may be used to collect chaff produced by punches that are used in systems other than an imaging system. Such modifications and variations that may be apparent to a person skilled in the art are intended to be included within the scope of this invention as defined by the accompanying claims.

What is claimed is:

1. A method used with an imaging system for collecting chaff produced by at least one punch, comprising the steps of:

providing a chaff tray having a cover formed by a plurality of removable fingers; and selectively removing a specific set of the removable fingers from the cover according to a location of each punch, thereby forming a respective opening in the cover for the collection of chaff produced by each punch in the imaging system.

2. The method of claim 1, further including the step of:

positioning the chaff tray below the at least one punch, wherein the chaff produced by each punch passes through its respective opening in the cover into the chaff tray for collection.

3. The method according to claim 1, further including the step of:

sealing areas of the cover located away from each punch by not removing the removable fingers located in those areas.

4. The method according to claim 1, further including the step of:

clearing chaff jams in the chaff tray.

5. The method according to claim 1, further including the step of:

removing chaff from the chaff tray.

6. The method according to claim 1, further including the step of:

attaching the chaff tray to the imaging system for recording data onto a supply of recording media, wherein the at least one punch is used to punch registration openings into the recording media.

7. The method according to claim 1, wherein the removing step further includes the step of:

attaching each removable finger to the cover using a separable structure.

8. The method according to claim 7, further including the step of:

forming the separable structure by providing each removable finger with an area of reduced material thickness.

9. A method for collecting chaff in an imaging system, the method comprising the steps of:

providing a chaff tray having a cover formed by a plurality of removable fingers;

positioning the chaff tray adjacent at least one punch; and selectively removing a specific set of the removable fingers from the cover, according to a location of each punch, to form a respective opening in the cover for the collection of chaff produced by each punch, the remaining removable fingers preventing the collected chaff from escaping from the chaff tray.

* * * * *